US006913495B2

(12) United States Patent
Matsuda

(10) Patent No.: US 6,913,495 B2
(45) Date of Patent: Jul. 5, 2005

(54) SMALL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/692,407

(22) Filed: Oct. 22, 2003

(65) Prior Publication Data

US 2004/0127109 A1 Jul. 1, 2004

(30) Foreign Application Priority Data

Oct. 23, 2002 (JP) ..... 2002-307970

(51) Int. Cl.[7] ..... B63H 21/22
(52) U.S. Cl. ..... 440/1; 440/84; 440/87
(58) Field of Search ..... 440/1, 84, 87

(56) References Cited

U.S. PATENT DOCUMENTS 6,213,820 B1 * 4/2001 Kanno ..... 440/1
6,712,651 B2 * 3/2004 Kanno ..... 440/1
2002/0151229 A1 * 10/2002 Kanno ..... 440/1

* cited by examiner

*Primary Examiner*—Stephen Avila
(74) *Attorney, Agent, or Firm*—Alleman Hall McCoy Russell & Tuttle LLP

(57) ABSTRACT

A small watercraft comprises a four-cycle engine, an engine speed sensor configured to output a signal according to an engine speed of the engine, first and second hydraulic switches each configured to output a signal according to a pressure of oil, and an electrical control unit configured to control operation of the engine based on signals from the engine speed sensor, and the first and second hydraulic switches. The electrical control unit enters a first detection mode when the engine speed is within a first range, and limits the operation of the engine when detecting that the hydraulic pressure is not more than a first threshold. The electrical control unit enters a second detection mode when the engine speed is within a second range, and causes a notification lamp to be lighted when detecting that the hydraulic pressure is not more than a second threshold.

10 Claims, 6 Drawing Sheets

SMALL WATERCRAFT

BACKGROUND OF THE INVENTION

1. Field of the Invention

The present invention relates to a small watercraft, and more particularly to a personal watercraft that gains a propulsion force by driving a water jet pump.

2. Description of the Related Art

In recent years, jet-propulsion personal watercraft, which are one type of small watercraft, have been widely used in leisure, sport, rescue activities, and the like. The personal watercraft comprises an engine mounted in a space within the watercraft which is surrounded by a hull and a deck. Conventionally, a two-cycle engine has been typically employed in the personal watercraft.

The personal watercraft is configured to have a water jet pump that pressurizes and accelerates water sucked from a water intake generally provided on a bottom hull surface and ejects it rearward from an outlet port. Thereby, the personal watercraft is propelled. In the jet-propulsion personal watercraft, a steering nozzle provided behind the outlet port of the water jet pump is swung either to the right or to the left, to change the ejection direction of the water to the right or to the left, thereby turning the watercraft to right or to the left.

In the engine mounted in the personal watercraft, oil is used to lubricate various components such as bearings to allow these components to operate smoothly, cool these components, or the like. In the two-cycle engine, the engine components are lubricated by the oil mixed in a fuel and suctioned into a crankcase together with the fuel.

In certain personal watercraft, four-cycle engines have been recently mounted instead of the two-cycle engines. The four-cycle engines employ a wet-sump system or a dry-sump system to control the oil in the engine. The oil is delivered at a proper pressure by an oil pump and circulates within the engine independently of the fuel.

In order for the oil to fully function in the four-cycle engine, the oil delivered by the oil pump is required to have a pressure (hydraulic pressure or oil pressure) in a proper range. However, in some cases, the oil is diluted by the fuel mixed therein due to a blow-by gas or the like, and thereby the hydraulic pressure is reduced and becomes lower than the proper range. Also, since the oil is consumed by long-time drive of the engine, the hydraulic pressure is reduced.

Such a reduced hydraulic pressure is undesirable to the engine. Especially in the four-cycle engine, the reduced hydraulic pressure causes insufficient lubrication, and it is therefore necessary to notify a rider of such reduction. In the conventional method, the rider is notified of reduction of the hydraulic pressure by lighting an oil lamp provided on an instrument panel upon detection of the reduction.

In general, a rotational shaft of the oil pump is coupled to a crankshaft of the engine. The hydraulic pressure increases with increasing engine speed, and is low during low engine speed, for example, at idling speed. Accordingly, in the conventional method, the oil lamp is configured not to be lighted when the hydraulic pressure is reduced due to the low engine speed, and to be lighted only when the hydraulic pressure becomes a value lower than a predetermined value (e.g., about 0.1 kg/cm$^2$ ) due to, for example, consumption of the oil. In this setting, it is necessary to set a threshold of the hydraulic pressure at which the oil lamp are lighted to a relatively low value. Under this condition, if the hydraulic pressure is slightly reduced from a proper value due to dilution of the oil or the like, this cannot be detected.

In another possible method, the rider is notified of slight reduction of the hydraulic pressure due to dilution of the oil or the like, by using a hydraulic-pressure indicator provided to sequentially display a hydraulic-pressure value. This leads to a very high cost.

The above described conditions may also occur in small watercraft other than the personal watercraft.

SUMMARY OF THE INVENTION

The present invention addresses the above described conditions, and an object of the present invention is to provide small watercraft capable of detecting slight reduction of a hydraulic pressure of oil due to dilution or the like in addition to relatively large reduction of the hydraulic pressure.

According to the present invention, there is provided a small watercraft comprising a four-cycle engine, an engine speed sensor configured to output a signal according to an engine speed of the engine, a hydraulic-pressure sensor configured to output a signal according to the pressure of oil that circulates within the engine, and a hydraulic-pressure detecting portion configured to detect an engine speed of the engine and the pressure of the oil based on the signal from the engine speed sensor and the signal from the hydraulic-pressure sensor, respectively, wherein the hydraulic-pressure detecting portion has a detection mode to detect whether or not the pressure of the oil obtained from the hydraulic-pressure sensor is not more than a predetermined threshold, when detecting that the engine speed obtained from the engine speed sensor is within a predetermined range.

In such a configuration, the detection mode can be set so that the hydraulic pressure is detected in normal travel during which the engine speed is higher than the engine speed in a time period from start to idling, and the threshold of the hydraulic pressure detected in the detection mode can be set to a relatively high hydraulic-pressure value at which dilution of the oil or the like can be detected. In other words, in the detection mode, it is possible to detect the hydraulic pressure that is higher than a proper hydraulic-pressure value in the time period from start to idling and lower than the proper hydraulic-pressure value during the normal travel. Therefore, when the engine is operating at a relatively high speed, slight reduction of the hydraulic-pressure due to dilution of the oil or the like can be detected before the hydraulic pressure is reduced and insufficient lubrication thereby takes place.

The small watercraft may further comprise a control portion configured to control an operation of the engine, wherein the control portion is configured to limit the engine speed to a predetermined engine speed or less when the hydraulic-pressure detecting portion detects that the pressure of the oil obtained from the hydraulic-pressure sensor is not more than the predetermined threshold. In such a configuration, when the hydraulic-pressure is reduced, an operation of the engine at the predetermined engine speed or less can be achieved while inhibiting the engine speed from becoming high. For example, when the hydraulic pressure is reduced in the small watercraft traveling in water, the watercraft can travel to reach the shore while inhibiting the engine speed from becoming high.

The small watercraft may further comprise a control portion configured to control an operation of the engine, and a notification portion configured to operate based on a signal from the control portion, wherein the control portion may be configured to output the signal to cause the notification portion to operate when the hydraulic-pressure detecting portion detects that the pressure of the oil obtained from the hydraulic-pressure sensor is not more than the predetermined threshold. In such a configuration, when the hydraulic-pressure is reduced, the notification portion such as a lamp or a buzzer can be activated to notify the rider of such reduction.

The detection mode may include a first detection mode to detect whether or not the pressure of the oil is not more than a first threshold when the engine speed of the engine is within a first predetermined range, and a second detection mode to detect whether or not the pressure of the oil is not more than a second threshold which is higher than the first threshold, when the engine speed is within a second range higher than the first range. In such a configuration, two types of hydraulic-pressure reduction due to different causes can be detected according to the engine speed. For example, in the first detection mode, a relatively large reduction of the hydraulic-pressure due to consumption of the oil or the like is detected, while, in the second detection mode, a relatively small reduction of the hydraulic pressure due to dilution of the oil or the like is detected. Thus, different types of reduction of the hydraulic pressure can be detected appropriately as necessary.

The small watercraft comprising the hydraulic-pressure detecting portion that enters the first detection mode or the second detection mode, may further comprise a control portion configured to control an operation of the engine, wherein the control portion is configured to control the engine speed to be not more than the predetermined engine speed when it is detected that the pressure of the oil is not more than the first threshold in the first detection mode. In such a configuration, only when it is detected that the hydraulic pressure is reduced in the first detection mode, the engine speed is inhibited from becoming high. Therefore, by configuring so that a relatively large reduction of the hydraulic-pressure is detected in the first detection mode, and relatively small reduction of the hydraulic pressure is detected in the second detection mode, the engine speed is not limited when the hydraulic pressure is slightly reduced, and the engine speed is limited only when the hydraulic pressure is reduced relatively significantly. Since the engine can operate at or below a predetermined engine speed while limiting the engine speed, the watercraft traveling in water can reach the shore while inhibiting the engine speed from becoming high when the hydraulic pressure is reduced.

The small watercraft may further comprise a control portion configured to control an operation of the engine, and a notification portion configured to operate based on a signal from the control portion, wherein the control portion is configured to output the signal to cause the notification portion to operate when it is detected that the pressure of the oil is not more than the second threshold in the second detection mode. In such a configuration, only when reduction of the hydraulic pressure is detected in the second detection mode, the notification portion such as the lamp or the buzzer is activated to notify the rider of such reduction. By combining the configuration for limiting the engine speed upon detection of the hydraulic pressure in the first detection mode with the configuration in the second detection mode, when the hydraulic pressure is reduced in the first detection mode, the engine speed is limited, while, when the hydraulic pressure is reduced in the second detection mode, the rider is notified of reduction of the hydraulic pressure by activation of the notification portion without limiting the engine speed.

The hydraulic-pressure sensor may include a first hydraulic-pressure sensor configured to output a signal according to the pressure of the oil in the first detection mode and a second hydraulic-pressure sensor configured to output a signal according to the pressure of the oil in the second detection mode. In such a configuration, by using two hydraulic-pressure sensors each comprised of a spring and an electric contact, which are simple and cheap, the hydraulic-pressure can be detected in the first detection mode and in the second detection mode.

The above and further objects and features of the invention will more fully be apparent from the following detailed description with accompanying drawings.

DETAILED DESCRIPTION OF THE PREFERRED EMBODIMENTS

Figure 1:
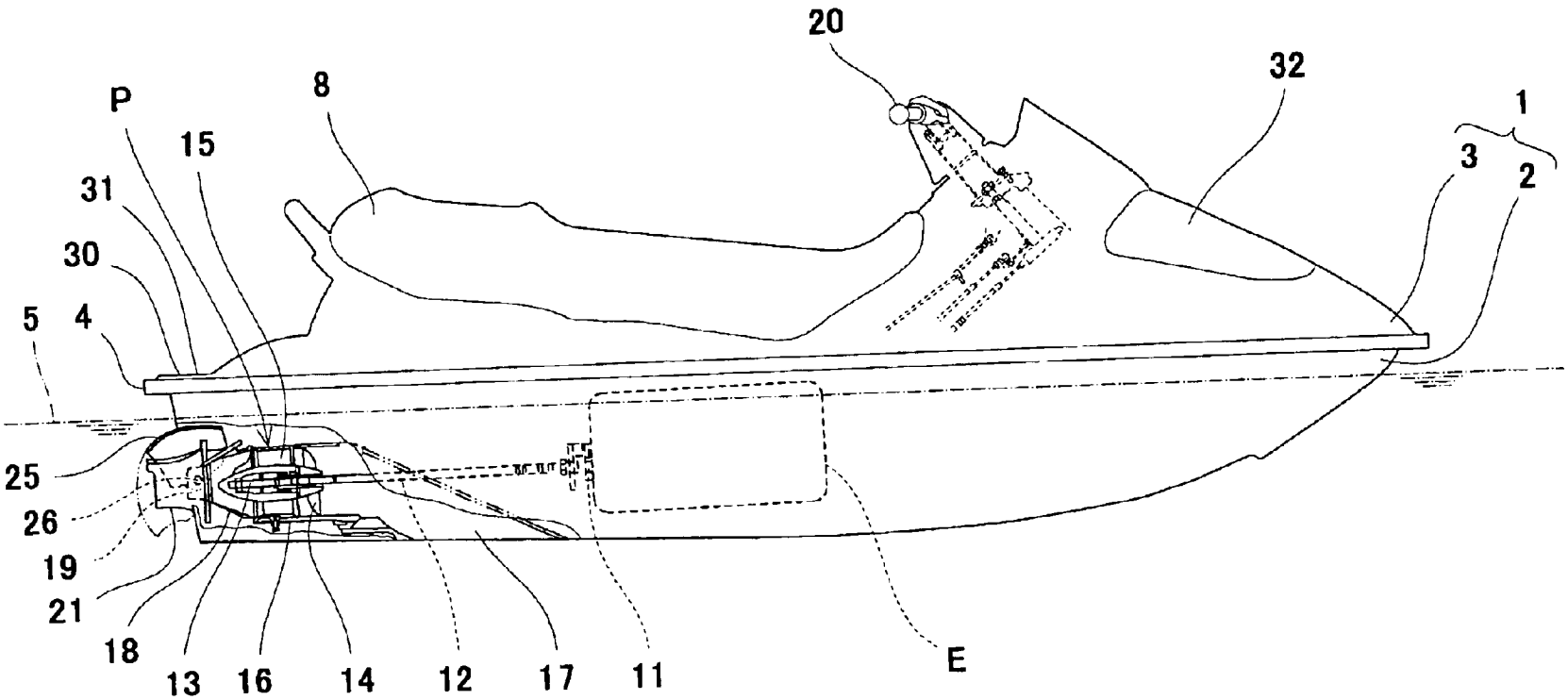
FIG. 1 is a side view of a personal watercraft according to an embodiment of the present invention.

Hereinafter, an embodiment of the small watercraft of the present invention will be described with reference to the accompanying drawings. Here, personal watercraft will be described. The personal watercraft in FIG. 1 is a straddle-type personal watercraft provided with a seat straddled by a rider. A body 1 of the watercraft comprises a hull 2 and a deck 3 covering the hull 2 from above. A line at which the hull 2 and the deck 3 are connected over the entire perimeter thereof is called a gunnel line 4. The gunnel line 4 is located above a waterline 5 of the watercraft.

Figure 2:
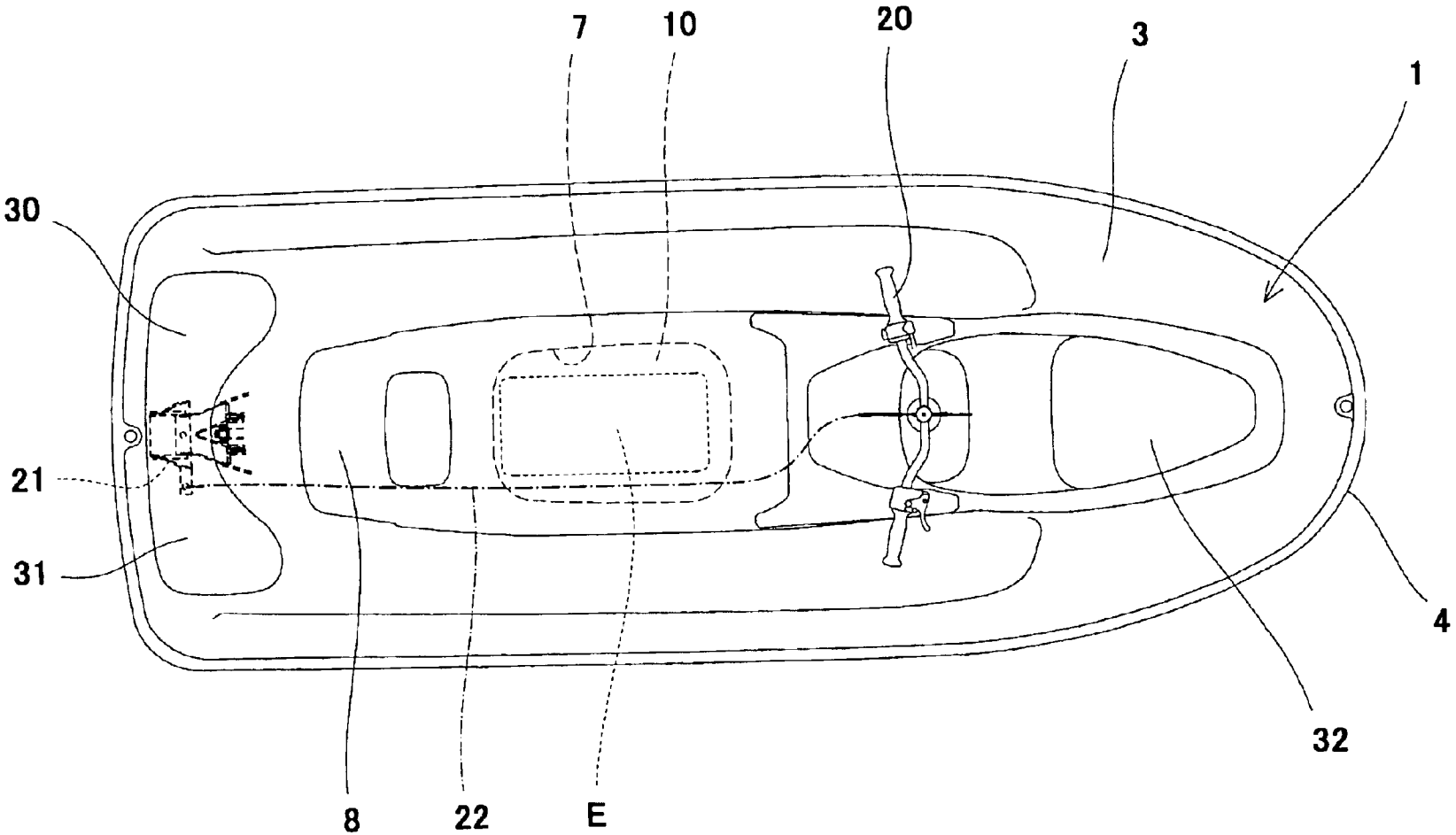
FIG. 2 is a plan view of the personal watercraft in FIG. 1.

As shown in FIG. 2, an opening 7, which has a substantially rectangular shape as seen from above is formed at a substantially center section of the deck 3 in the upper portion of the body 1 such that its longitudinal direction corresponds with the longitudinal direction of the body 1. A seat 8 is removably mounted over the opening 7.

An engine room 10 is provided in a space defined by the hull 2 and the deck 3 below the opening 7. An engine E for driving the personal watercraft is mounted within the engine room 10. The engine room 10 has a convex-shaped transverse cross-section and is configured such that its upper portion is smaller than its lower portion. In this embodiment, the engine E is an in-line four-cylinder four-cycle engine. As shown in FIG. 1, the engine E is mounted such that a crankshaft 11 extends along the longitudinal direction of the body 1. Within the engine E, oil being delivered by an oil pump (not shown) circulates through an oil gallery to lubricate and cool various components.

An output end of the crankshaft 11 is rotatably coupled integrally with a pump shaft 13 of a water jet pump P provided on the rear side of the body 1 through a propeller shaft 12. An impeller 14 is attached on the pump shaft 13. Fairing vanes 15 are provided behind the impeller 14. The impeller 14 is covered with a pump casing 16 on the outer periphery thereof.

A water intake 17 is provided on the bottom of the body 1. The water intake 17 is connected to the pump casing 16 through a water passage. The pump casing 16 is connected to a pump nozzle 18 provided on the rear side of the body 1. The pump nozzle 18 has a cross-sectional area that gradually reduces rearward, and an outlet port 19 is provided on the rear end of the pump nozzle 18.

The water outside the watercraft is sucked from the water intake 17 and fed to the water jet pump P. The water jet pump P pressurizes and accelerates the water and the fairing vanes 15 guide water flow behind the impeller 14. The water is ejected through the pump nozzle 18 and from the outlet port 19 and, as the resulting reaction, the watercraft obtains a propulsion force.

In FIGS. 1 and 2, reference numeral 20 denotes a bar-type steering handle. The steering handle 20 is connected to a steering nozzle 21 provided behind the pump nozzle 18 through a cable 22 (indicated by a dashed line in FIG. 2). When the rider rotates the handle 20 clockwise or counterclockwise, the steering nozzle 21 is swung toward the opposite direction so that the ejection direction of the water being ejected through the pump nozzle 18 can be changed, and the watercraft can be correspondingly turned to any desired direction while the water jet pump P is generating the propulsion force.

As shown in FIG. 1, a bowl-shaped reverse deflector 25 is provided on the rear side of the body 1 so as to have the steering nozzle 21 inside the deflector 25 such that it can vertically swing around a horizontally mounted swinging shaft 21. The deflector 25 is swung downward to a lower position around the swinging shaft 26 to deflect the ejected water from the steering nozzle 21 forward and, as the resulting reaction, the personal watercraft moves rearward.

In FIGS. 1 and 2, a rear deck 30 is provided in the rear section of the body 1. The rear deck 30 is provided with an openable rear hatch cover 31. A rear compartment (not shown) with a small capacity is provided under the rear hatch cover 31. In FIGS. 1 and 2, a front hatch cover 32 is provided in a front section of the body 1. A front compartment (not shown) is provided under the front hatch cover 32 for storing equipments and the like.

Figure 3:
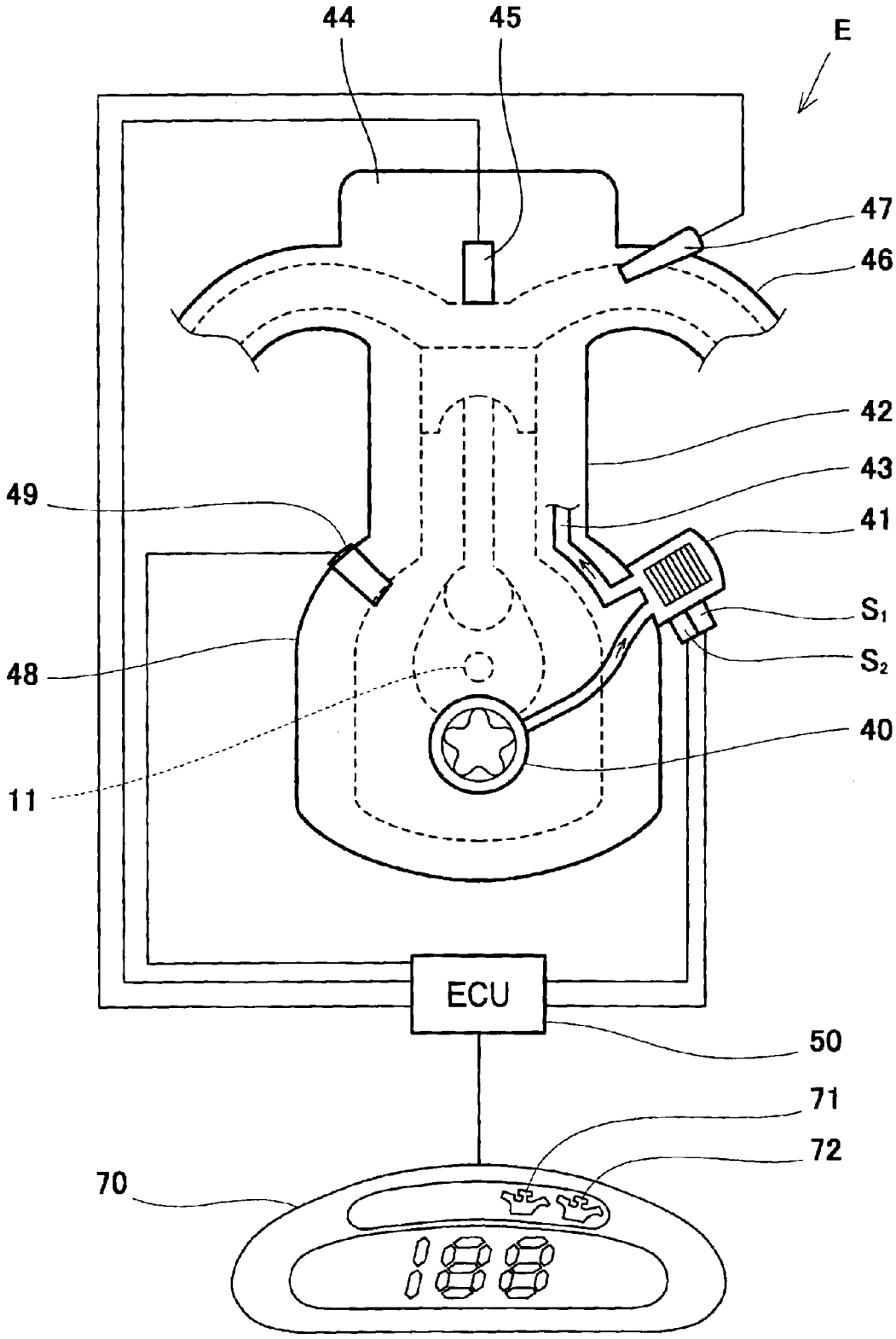
FIG. 3 is a schematic view showing a configuration of an engine mounted in the personal watercraft according to the embodiment and its peripheral devices.

Referring to FIG. 3, the engine E employs a wet-sump system to circulate oil.

As shown in FIG. 3, the engine E is provided with an oil pump 40 rotatable together with the crankshaft 11. As the oil pump 40, any type of oil pump may be used, including an internal gear pump, a trochoid pump, a gear pump, etc. The engine E is further provided with a cylindrical oil filter 41 on a side portion thereof. The oil filter 41 has a relief valve mechanism (not shown). A discharge port of the oil pump 40 communicates with an oil inlet of the oil filter 41 through a pipe. An oil outlet of the oil filter 41 communicates with an oil gallery 43 formed within a cylinder block 42 of the engine E.

The oil filter 41 is provided with a first hydraulic-pressure switch (first hydraulic-pressure sensor) S1 and a second hydraulic-pressure switch (second hydraulic-pressure sensor) S2 on a side portion thereof. The first and second hydraulic-pressure sensors S1 and S2 may be known ones each configured to output an electric signal according to a hydraulic pressure. For example, each of these hydraulic-pressure switches may have a spring and an electric contact, and may be configured to turn on the electric contact by a reaction force of the spring, and output the electric signal, when the hydraulic pressure becomes a predetermined value or less.

The first hydraulic-pressure switch S1 of this embodiment is configured to turn on the electric contact and output the electric signal when the hydraulic pressure within the oil filter 41 becomes lower than a first threshold V1. Here, the first threshold V1 is set to a relatively low value. The second hydraulic-pressure switch S2 of this embodiment is configured to turn on the electric contact and output the electric signal when the hydraulic pressure within the oil filter 41 becomes lower than a second threshold V2. Here, the second threshold V2 is set to a value relatively higher than the first threshold V1 (V2>V1).

The cylinder head 44 of the engine E is provided with an ignition device 45. An air-intake pipe 46 communicates with an air-intake port of the engine E and is provided with a fuel injection device 47. A crankcase 48 of the engine E is provided with a crank position sensor (engine speed sensor: hereinafter expressed as "CPS") 49 capable of detecting a rotational position and the number of rotations of the crankshaft 11.

The personal watercraft of this embodiment comprises an electrical control unit (ECU) 50. The ECU 50 includes a hydraulic-pressure detecting portion and a control portion. As shown in the block diagram of FIG. 4, the ECU 50 comprises a CPU 51, a RAM 52, a ROM 53, and the like. The CPU 51 is configured to perform calculation based on data loaded from the RAM 52 or the ROM 53 or data input externally of the ECU 50, and output calculation data. The RAM 52 is configured to temporarily store the calculation data from the CPU 51 or the data externally input. The ROM 53 contains various programs 54 required to operate the ECU 50.

The CPU 51 is configured to detect hydraulic pressures based on the signals output from the hydraulic-pressure switches S1 and S2 and received through input interfaces 60 and 61 and calculate an engine speed of the engine E based on a signal output from the CPS 49 and received through an input interface 62. Further, the CPU 51 is configured to output signals through output interfaces 63 and 64 in order to control operations of the ignition device 45 and the fuel injection device 47. More specifically, the ECU 50 is configured to control an ignition timing in the ignition device 45 or a injection timing and a fuel amount of a fuel in the fuel injection device 47 based on the signal output from the CPU 51, thereby controlling the engine speed of the engine E.

Figure 4:
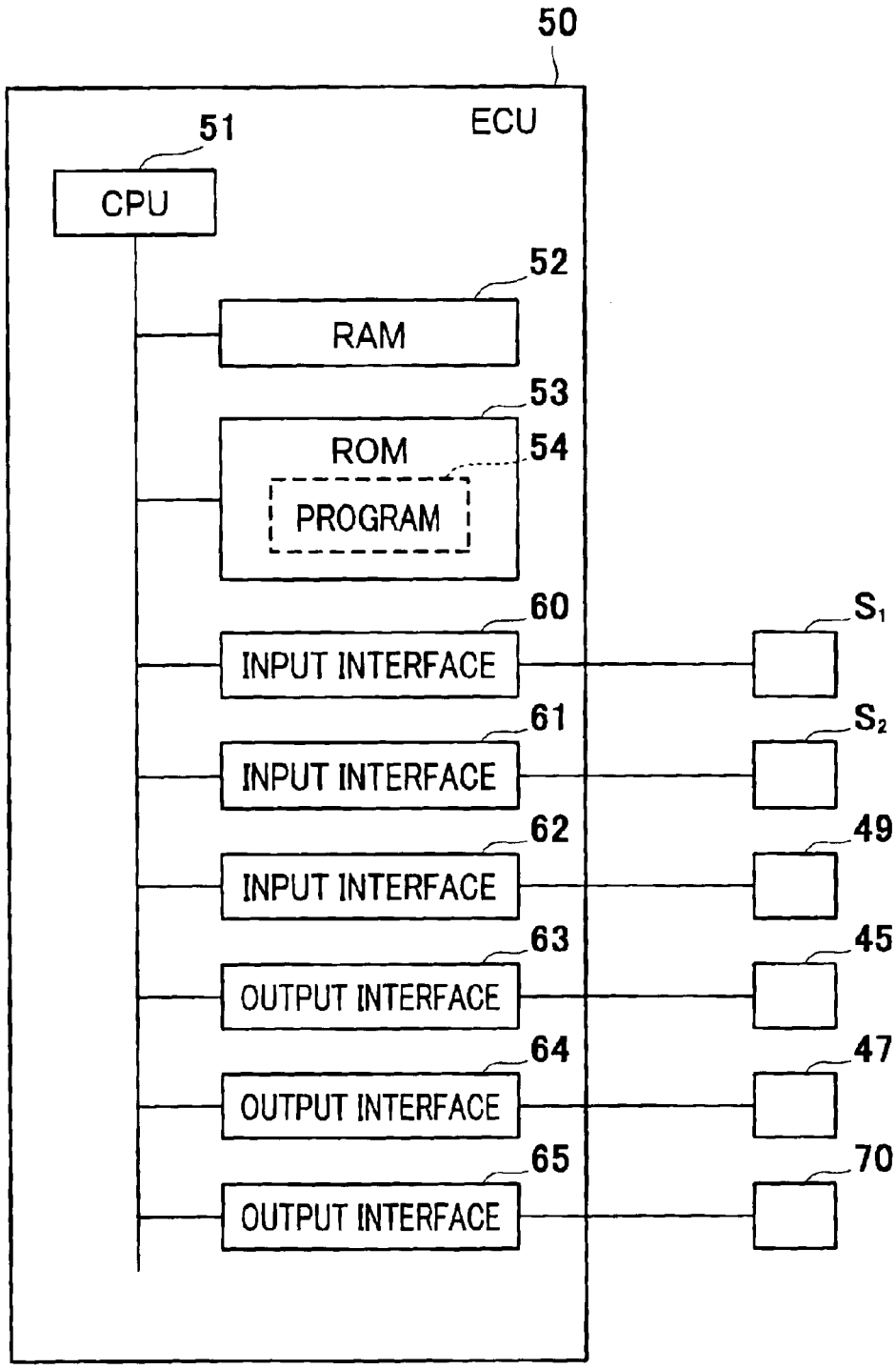
FIG. 4 is a block diagram schematically showing a configuration of an electrical control unit (ECU) in FIG. 3.

As shown in FIG. 4, the CPU 51 is connected to an instrument panel 70 of the watercraft in FIG. 3 through an output interface 65. As shown in FIG. 3, two notification lamps 71 and 72 are provided on the instrument panel 70. These lamps 71 and 72 are comprised of light emitting devices such as LEDs. The lamps 71 and 72 are lighted based on the signals output from the CPU 51.

The ECU 50 takes two modes based on the engine speed of the engine E. Specifically, the ECU 50 is configured to cause the CPU 51 to calculate the engine speed of the engine E (the number of rotations of the crankshaft 11) based on the signal output from the CPS 49 and enter a mode (first detection mode) to detect whether or not the signal is output from the first hydraulic switch S1 when the calculated engine speed is within a predetermined range (first range). On the other hand, the ECU 50 is configured to enter a mode (second detection mode) to detect whether or not the signal is output from the second switch S2 when the calculated engine speed is within another predetermined range (second range).

Figure 5:
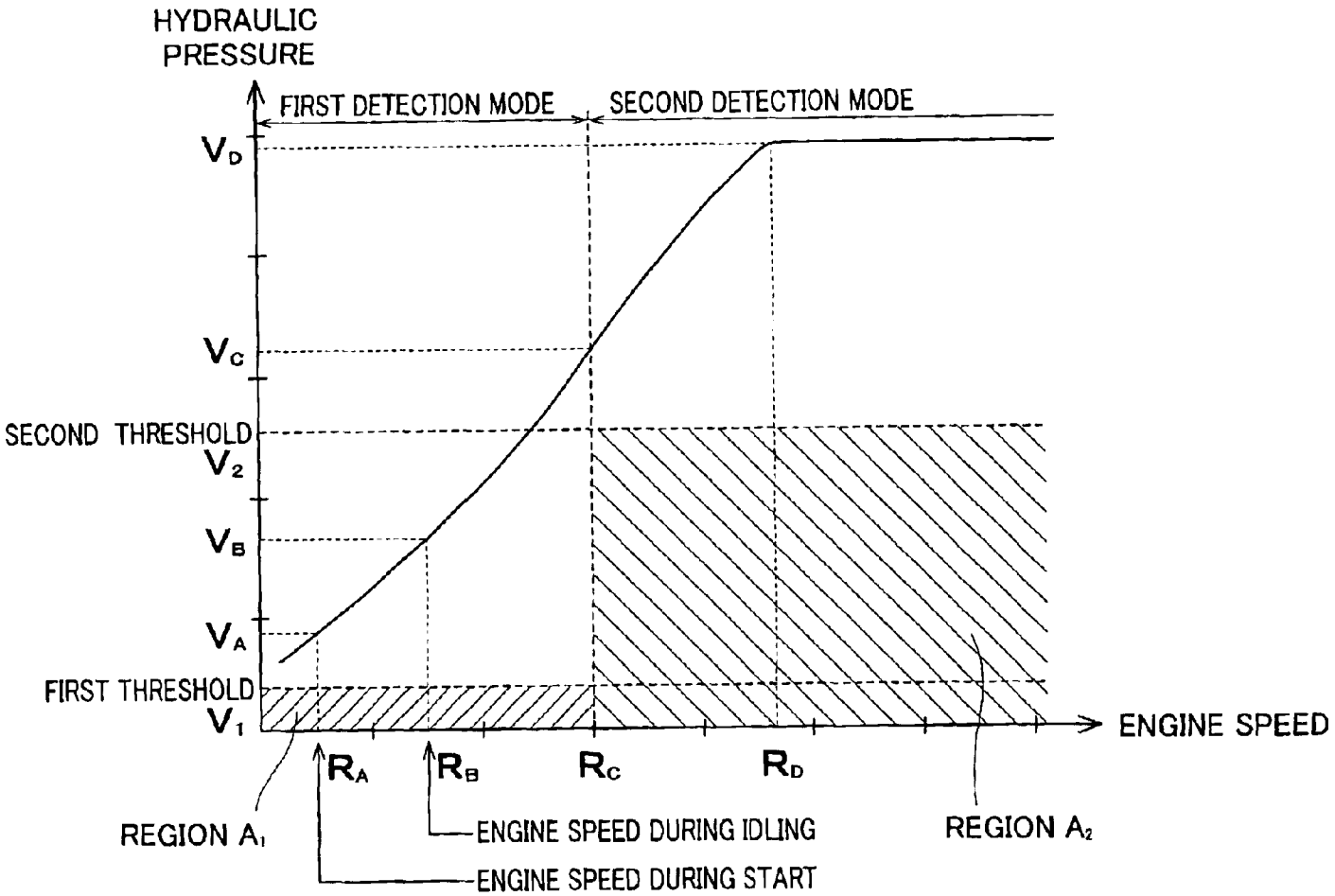
FIG. 5 is a graph showing an example of a hydraulic pressure having a proper value relative to an engine speed of the engine.

FIG. 5 is a graph showing the first and second detection modes in more detail. In FIG. 5, an ordinate axis represents a hydraulic pressure and an abscissa axis represents an engine speed of the engine E. In this graph, the hydraulic pressure having a proper value relative to the engine speed is represented by a solid line.

As shown in FIG. 5, when the hydraulic pressure has a proper value relative to the engine speed, the engine speed during start of the engine E is RA and the hydraulic pressure is VA (V2>VA>V1). The engine speed during idling is RB (RB>RA) and the corresponding hydraulic pressure is VB (V2>VB>VA). And, the engine speed during traveling at a relatively low speed is RC (RC>RB) and the corresponding hydraulic pressure is VC (VC>V2). The hydraulic-pressure value increases with an increase in the engine speed, and when the engine speed becomes RD (RD>RC) and the hydraulic pressure becomes VD (VD>VC), the relief valve mechanism is activated so that the hydraulic pressure does not exceed VD even if the engine speed further increases.

In this embodiment, the first range is defined as the engine speed less than RC, and the second range is defined as the engine speed of not less than RC. When the engine speed of the engine E is within the first range, the ECU 50 enters the first detection mode and detects whether or not the signal is output from the first hydraulic-pressure switch S1 while, when the engine speed is within the second range, the ECU 50 enters the second detection mode and detects whether or not the signal is output from the second hydraulic-pressure switch S2.

As described above, the first hydraulic-pressure switch S1 outputs the signal when the hydraulic pressure is not more than the first threshold V1, and the second hydraulic-pressure switch S2 outputs the signal when the hydraulic pressure is not more than the second threshold V2. Therefore, in the first detection mode and under the condition in which the hydraulic pressure is not more than V1 (region A1), the ECU 50 receives the signal from the first hydraulic-pressure switch S1, while, in the second detection mode and under the condition in which the hydraulic pressure is not more than V2 (region A2), the ECU 50 receives the signal from the second hydraulic-pressure switch S2.

As shown in FIG. 5, while the hydraulic pressure has a proper value, it has a value larger than the first threshold V1 in the first detection mode from start of the engine E to the engine speed Rc, so that the signal is not output from the first hydraulic-pressure switch S1. And, the hydraulic pressure has a value not less than Vc which is larger than the second threshold V2 in the second detection mode in which the engine speed is not less than Rc, so that the signal is not output from the second hydraulic-pressure switch S2.

Figure 6:
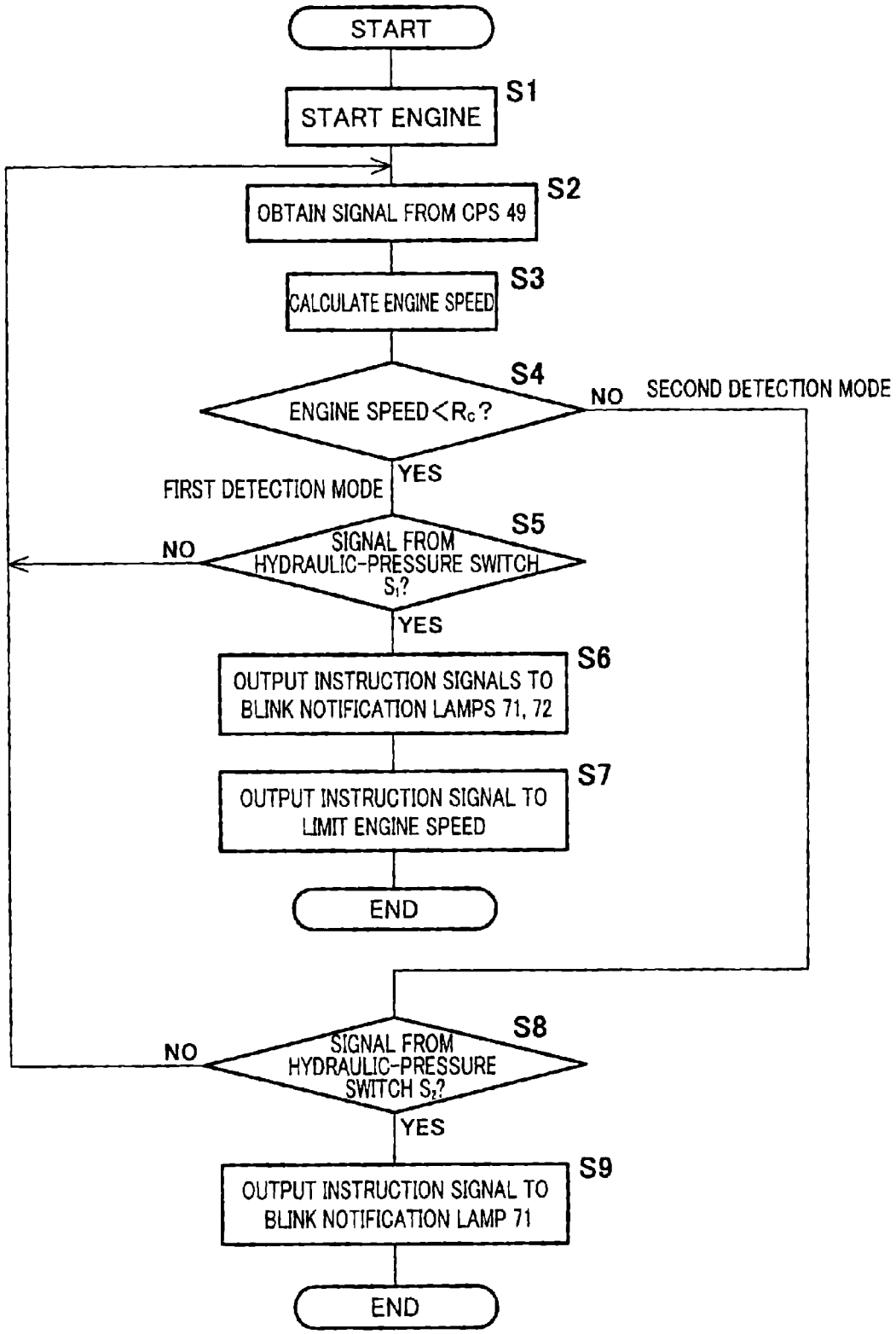
FIG. 6 is a flowchart showing an engine control process performed by the ECU.

Subsequently, control of the engine E executed by the ECU 50 based on the signals from the hydraulic-pressure switches S1 and S2 will be described with reference to a flowchart in FIG. 6. As shown in FIG. 6, upon start of the engine E (Step 1), the CPU 51 within the ECU 50 obtains the signal output from the CPS 49 through the input interface 62 (Step 2). The CPU 51 calculates the engine speed of the engine E based on the obtained signal (Step 3), and judges whether or not the calculated engine speed is less than Rc (Step 4).

When judging that the calculated engine speed is less than Rc in Step 4 (YES), the CPU 51 enters the first detection mode, and judges whether or not the signal is output from the first hydraulic-pressure switch S1 (Step 5). As shown in FIG. 5, when the engine speed ranges from zero to Rc, the CPU 51 enters the first detection mode and judges whether or not the signal is output from the first hydraulic-pressure switch S1, thereby judging whether or not the hydraulic pressure is within the region A1 which is not more than the first threshold V1. It does not matter whether or not the signal is output from the second hydraulic-pressure switch S2 in the first detection mode.

When judging that the signal is outputted from the first hydraulic-pressure switch S1 in Step 5 (YES), the CPU 51 outputs instruction signals to cause the notification lamps 71 and 72 to be lighted (Step 6), and further outputs proper instruction signals to the ignition device 45 and the fuel injection device 47 (Step 7) in order to control the engine speed. Specifically, the CPU 51 executes control so that the ignition timing in the ignition device 45 is delayed, the fuel injected from the fuel injection device 47 is lessened, and the injection timing is delayed, thereby controlling the engine speed of the engine E within a limited engine speed. Thus, by lighting the notification lamps 71 and 72 and controlling the engine speed of the engine E, the rider is notified that the hydraulic pressure is reduced due to, for example, consumption of oil.

The limited engine speed of the engine E may be set to, for example, 3000 rpm or less. By setting the engine speed to 3000 rpm or less, the watercraft travels in water to reach the shore even when the hydraulic pressure is reduced in the watercraft traveling in water.

And, when judging that the signal is not output from the first hydraulic-pressure switch S1 in Step 5 (NO), the CPU 51 repeats the procedure from Step 2.

On the other hand, when judging that the engine speed of the engine E is not less than Rc in Step 4 (NO), the CPU 51 enters the second detection mode and judges whether or not the signal is output from the second hydraulic-pressure switch S2 (Step 8). Specifically, as shown in FIG. 5, when the engine speed is not less than Rc, the CPU 51 enters the second detection mode and judges whether or not the signal is output from the second hydraulic-pressure switch S2, thereby judging whether or not the hydraulic pressure is within the region A2 of not more than the second threshold V2.

When judging that the signal is outputted from the second hydraulic-pressure switch S2 in Step 8 (YES), the CPU 51 outputs an instruction signal to cause only the notification lamp 71 to be lighted (Step 9). By lighting only the notification lamp 71, the rider is notified that the hydraulic pressure is reduced only slightly due to dilution of the oil or the like. Therefore, the rider can judge that the oil should be changed only based on lighting of the notification lamp 71.

When judging that the signal is not outputted from the second hydraulic-pressure switch S2 in Step 8 (NO), the CPU 51 repeats the procedure from the Step 2.

As should be appreciated from the above, since different hydraulic values are detected in the first detection mode corresponding to a relative low range of the engine speed and in the second detection mode corresponding to a relatively high range of the engine speed, the hydraulic pressure can be detected flexibly according to the engine speed of the engine E, and when the hydraulic pressure is reduced, the rider is notified of this in a suitable manner according to the extent to which hydraulic pressure is reduced.

The first range and the second range of the engine speed for respectively determining the first detection mode and the second detection mode may be suitably set and may overlap with each other. For example, the first range may be set over the whole range of the engine speed and the second range may be set to overlap with the first range when the engine speed is not less than Rc. In such setting, when the engine speed is less than Rc, it can be detected that the hydraulic pressure is reduced due to consumption of the oil or the like, while when the engine speed is not less than Rc, it can be detected that the hydraulic pressure is slightly reduced due to dilution of the oil or the like and the hydraulic pressure is reduced due to consumption of the oil or the like, and the rider is notified of both of these information.

As a matter of course, the configuration described in this embodiment is only illustrative and other configurations may be employed. For example, the hydraulic-pressure switches S1 and S2 may be positioned in the pipe through which the oil pump 40 and the oil filter 41 are connected to each other, for example, on the oil gallery 43. Alternatively, the two notification lamps 71 and 72 may be replaced by a notification lamp capable of emitting different-color lights based on the signal from the ECU 50. As another alternative, the notification lamps 71 and 72 may be replaced by a notification buzzer that sounds to notify the rider of reduction of the hydraulic pressure. Further, the hydraulic-pressure switches S1 and S2 may be replaced by a hydraulic-pressure switch capable of operating both in the first and second detection modes. Moreover, three or more detection modes may be set to achieve flexible and appropriate detection of the hydraulic pressure.

In accordance with the embodiment of the present invention, especially in the small watercraft in which the four-cycle engine is mounted, slight reduction of the hydraulic pressure due to dilution of the oil or the like as well as reduction of the hydraulic pressure due to consumption of the oil or the like, can be detected, and the rider can be notified of such reduction in a suitable manner according to the extent to which the hydraulic pressure is reduced.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A small watercraft comprising:

a four-cycle engine;

an engine speed sensor configured to output a speed signal according to an engine speed of the engine;

a hydraulic-pressure sensing device configured to output a pressure signal according to a pressure of oil that circulates within the engine; and an electric control unit including a detecting portion configured to detect the engine speed of the engine based on the speed signal and the pressure of the oil based on and the pressure signal to compare a threshold of the pressure of the oil preset according to the engine speed to the pressure of the oil, and to output an abnormality signal, and a control portion configured to control the watercraft according to the abnormality signal from the detecting portion, wherein the detecting portion has a plurality of detection modes, each of which is defined by a plurality of engine speed ranges, including predetermined numerical ranges, and the threshold is constant in each of the detection modes and increases with increasing engine speed range, wherein in each of the detection modes, the detecting portion outputs the abnormality signal to the control portion when detecting that the engine speed is in the engine speed range corresponding to the detection mode and the pressure of the oil is not more than the threshold corresponding to the detection mode.

2. The small watercraft according to claim 1, wherein in one of the detection modes, the control portion limits the engine speed to a predetermined engine speed or less when the control portion receives the abnormality signal from the detecting portion.

3. The small watercraft according to claim 1, further comprising:

a notification portion configured to operate based on a signal from the control portion, wherein in one of the detection modes, the control portion is configured to output the signal to cause the notification portion to operate when the control portion receives the abnormality signal from the detecting portion.

4. The small watercraft according to claim 1, wherein the detection mode comprises:

a first detection mode corresponding to a lower first engine speed range including an idling engine speed and a first threshold of the pressure of the oil; and a second detection mode corresponding to a higher second engine speed range higher than the first engine speed range and a second threshold of the pressure of the oil which is higher than the first threshold.

5. The small watercraft according to claim 4, wherein the control portion is configured to control the engine speed to be not more than a predetermined engine speed when it is detected that the pressure of the oil is not more than the first threshold in the first detection mode.

6. The small watercraft according to claim 4, further comprising:

a notification portion configured to operate based on a signal from the control portion, wherein the control portion is configured to output the signal to cause the notification portion to operate when it is detected that the pressure of the oil is not more than the second threshold in the second detection mode.

7. The small watercraft according to claim 4, wherein the hydraulic-pressure sensing device includes a first hydraulic-pressure sensor configured to output a first pressure signal when detecting that the pressure of oil is not more than the first threshold in the first detection mode and a second hydraulic-pressure sensor configured to output a second pressure signal when detecting that the pressure of oil is not more than the second threshold in the second detection mode.

8. The small watercraft according to claim 1, wherein the hydraulic-pressure sensing device is configured to output the pressure signal when detecting that the pressure of oil is not more than the predetermined threshold.

9. The small watercraft according to claim 4, wherein the control portion is configured to reduce the engine speed when it is detected that the engine speed is within the first engine speed range and the pressure of the oil is not more than the first threshold, and to cause the notification portion to operate when it is detected that the engine speed is within the second engine speed range and the pressure of the oil is not more than the second threshold.

10. The small watercraft according to claim 4, wherein the control portion is configured to reduce the engine speed when it is detected that the engine speed is within the first engine speed range or the second engine speed range and the pressure of the oil is not more than the first threshold, and to cause the notification portion to operate when it is detected that the engine speed is within the second engine speed range and the pressure of the oil is not more than the second threshold.

* * * * *